United States Patent [19]

Pusterhofer

[11] 4,408,367

[45] Oct. 11, 1983

[54] END BRUSH

[75] Inventor: Ronald J. Pusterhofer, Chesterland, Ohio

[73] Assignee: Advance Brushes, Inc., Cleveland, Ohio

[21] Appl. No.: 255,367

[22] Filed: Apr. 20, 1981

[51] Int. Cl.[3] ..... A46B 7/08

[52] U.S. Cl. ..... 15/180; 29/509; 29/522 R; 15/198; 300/21

[58] Field of Search ..... 15/180, 198, 200, 179; 29/520, 523, 509, 522; 300/21

[56] References Cited

U.S. PATENT DOCUMENTS

| | | | |
|---|---|---|---|
| 959,191 | 5/1910 | Abbott | 15/179 |
| 1,396,630 | 11/1921 | Higbee | 15/180 |
| 2,276,050 | 3/1942 | Leighton | 29/509 |
| 2,495,559 | 1/1950 | Weiler | 15/198 |
| 3,335,444 | 8/1967 | Weiler | 15/180 X |

*Primary Examiner*—Peter Feldman

*Attorney, Agent, or Firm*—Pearne, Gordon, Sessions, McCoy, Granger & Tilberry

[57] ABSTRACT

An end brush construction in which a cup-shaped bristle holder is permanently attached to an arbor by deforming the arbor in place on the holder. As disclosed, the arbor is caused to freely upset radially into a surrounding zone of the cup holder. Where the cup holder is formed from sheet material, it can be provided with an axially extending flange to increase the support area which is engaged by the expanded arbor.

14 Claims, 7 Drawing Figures

END BRUSH

BACKGROUND OF THE INVENTION

The invention relates to rotary brush constructions, and in particular to an end brush assembly adapted for power operation.

An end or cup-type rotary brush is formed with its bristles extending generally in parallel alignment with its axis of rotation. In one particular type of end brush, the bristle material is carried in a cup-shaped holder. A stem extending oppositely of the bristles at the center of the cup is provided for mounting the brush in a chuck, collet, or like tool holding device. Prior brush designs in which the stem and cup are integral are relatively expensive to manufacture when fabricated as a screw machine part. Integral stem and cup units that are upset or forged to shape are also expensive when tooling cost is considered. Integral stem and cup units, moreover, in the past have been relatively massive owing to a characteristically heavy wall thickness in the cup structure.

SUMMARY OF THE INVENTION

The invention pertains to an end brush unit comprising a unique stem and cup holder assembly which affords features that are advantageous in both manufacture and ultimate use. More particularly, the stem and cup holder assembly involves a manner of mechanically interlocking these elements in a construction which is easily accomplished in manufacture and which resists stress-induced failure in use.

As disclosed, the stem, an integral part of an arbor, is permanently affixed to the cup holder by first assembling it through a central bore of the holder and then upsetting a hub portion of the arbor into tight radial engagement with this bore. In this process, tooling is arranged to produce a free upset in the hub section so that the hub material is free of lateral restriction or confinement by the tooling. As a consequence, the hub is permanently radially deformed to a relatively high degree in the cup holder bore, which in turn is also significantly radially enlarged. As disclosed, the upset hub section is changed from a generally cylindrical original shape to a final conical shape. The extent and direction of cold flow required of the hub section for the transition from the cylindrical to conical shape is moderate, so that steel of high strength but of limited formability can be utilized for making the stem, hub, and other arbor sections. This limited restructuring of the hub section allows the use of an arbor preform which itself has been cold forged to shape and which may thus be in a highly worked, internally stressed condition. The final configuration of the arbor hub section is generally conical and, as a result, affords a locking taper effect with the cup holder bore to produce a reliable torque transmitting joint therebetween.

Since, according to the invention, the stem and cup are separately fabricated, the selection of materials for either one of these parts need not be unduly compromised by restrictions imposed on or by the other part. With the disclosed free radial upset of the arbor hub into the cup bore, any tendency of springback in the upset hub section when released by forming tools is fully compensated for by similar springback in the body of the cup. This feature assures that the cup remains tightly engaged with the arbor hub during the full life of the brush.

In a preferred construction, the cup holder is economically fabricated as a sheet metal stamping. The cup can thereby be formed with a thin wall structure to reduce weight, gyroscopic forces, and vibrational stresses on the arbor during use.

In accordance with an important feature of the invention, where the cup holder is stamped from sheet metal, the cup holder may be provided with an axially projecting flange at the periphery of the hub receiving bore. This flange is arranged to effectively extend the axial length of the receiving bore beyond that of the end wall sheet thickness of the cup holder. This long bore structure enhances the stability and rigidity of the stem and cup assembly. The springback of this bore extending flange can significantly exceed that of the upset hub section, and assures that the cup holder is permanently and reliably locked to the arbor.

DESCRIPTION OF THE PREFERRED EMBODIMENTS

Figures 1A, 1B, 1C, 1D, 2:
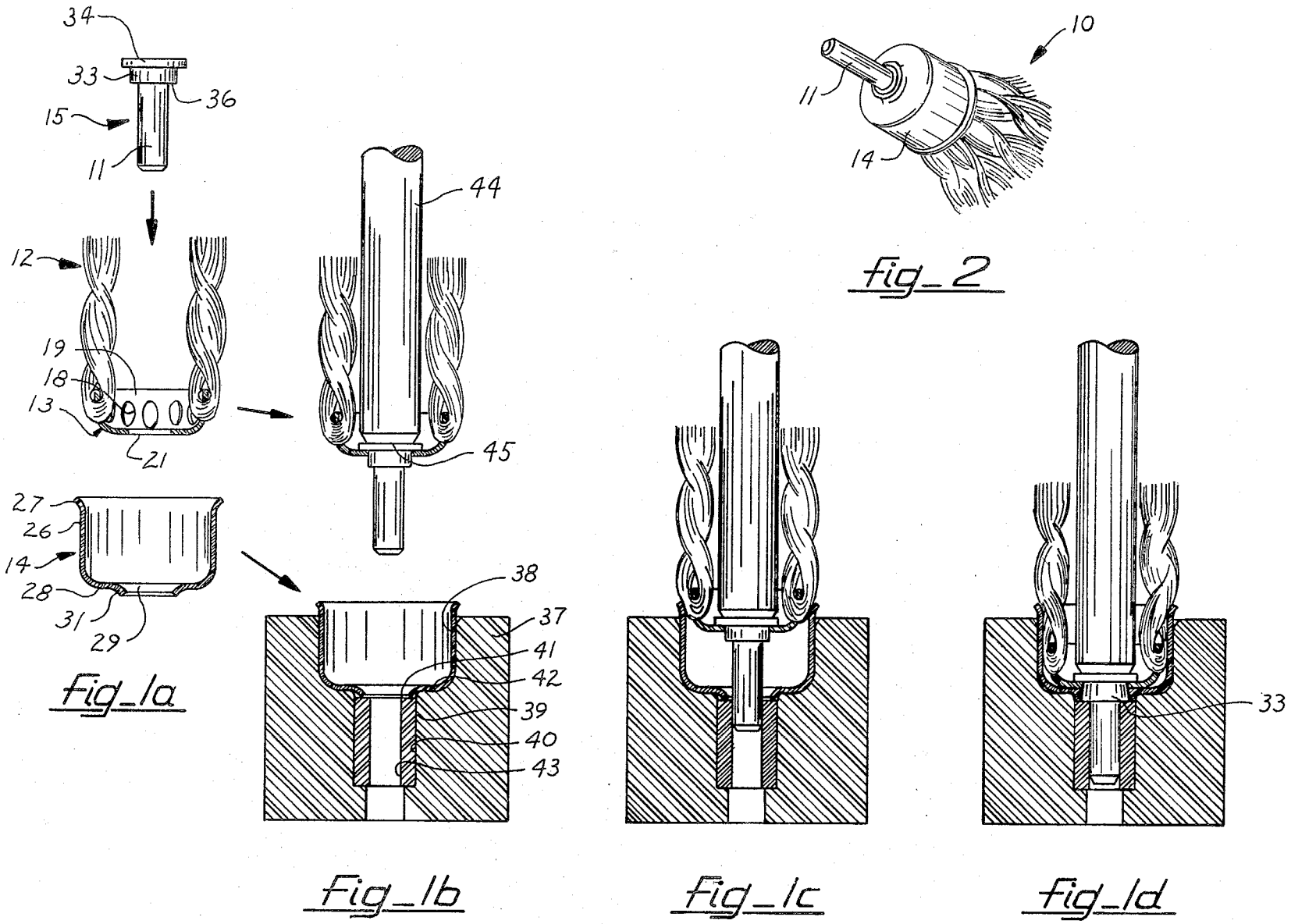
FIG. 1*a* is an elevational view of various parts making up a brush assembly in one embodiment of the invention, with certain parts in cross section.
FIG. 1*b* is a view of the component parts of FIG. 1*a*, in an early stage of their assembly, and tooling for effectuating their final assembly.
FIG. 1*c* is a view similar to FIG. 1*b*, but illustrating the parts in a later stage of assembly.
FIG. 1*d* is a view of the brush unit in a final stage of assembly.
FIG. 2 is a perspective rear view of the brush unit.

In FIG. 2, there is shown a rotary end brush 10 constructed in accordance with the present invention. The end brush 10 includes a rearwardly extending, centrally disposed stem 11 adapted to be mounted in a collet, chuck, or other tool rotating device. As will be apparent from the description hereinbelow, the illustrated brush unit 10 is a type generally referred to as a "knot" construction wherein separate bristle bundles have their bristles twisted upon one another. The bundles of bristle material, designated 12, extend generally axially in parallel alignment with the stem 11. The bristles are anchored in a disc 13, which, in turn, is retained in a cup-shaped holder 14 by an arbor 15 an integral portion of which forms the stem 11.

Bristles 12 are ordinarily tempered steel wire, but may be other materials, such as stainless steel, brass, or other known compositions. The disc 13 is a sheet metal part formed with circumferentially spaced apertures 18. Each of these apertures 18 has a bristle bundle associated with it. The bights of the bristles of the respective bundle are folded over an aperture 18 and thereafter the bristles are twisted or knotted on themselves. The disc 13 is cupped to form a forwardly axially extending flange 19, preferably after assembly of the bristles thereon. In this cup configuration, the flange wall areas of the disc 13 and edges of the apertures 18 straddled by the folded bristle filaments extend generally in an axial direction. The disc 13 is formed with a central aperture 21.

The illustrated cup-shaped holder 14 is a sheet metal stamping of mild carbon steel or, where desired, of aluminum, brass, or other metal. At its forward end, a generally cylindrical sidewall 26 of the cup holder 14 is turned outwardly with a circumferentially continuous lip 27 to provide a rounded stress-relieving surface for radial support of the bristle material 12. A radial end wall 28 integral with the sidewall 26 is formed with a central aperture or bore 29. This bore 29 is axially extended by a generally axially directed flange 31 integrally formed with the end wall 28. The axial length of the flange 31 is, at least, substantially equal to the thickness of the end wall 28.

Preferably, the arbor 15 in a preformed condition before assembly with the remaining brush parts is a multidiameter part made by cold forging steel wire stock. Ideally, the wire stock is a high strength steel alloy, such as 4310. The arbor 15, for example, is formed in a cold heading machine by known techniques. An efficient manner for producing the arbor preform according to known cold forging techniques involves the use of a blank sheared from wire stock with a nominal diameter approximately equal to that of an intermediate diameter section or hub 33. Such a blank is forward extruded in a suitable die to form the stem section 11 and is headed by suitable tools to form a head section 34. An advantage of using a cold forged arbor 15 in the brush assembly 10 is that the forging process improves the metal grain structure, and thereby the physical strength, of the part. The stem and hub sections 11, 33 are substantially cylindrical in their preformed state, while a shoulder surface 36 extends between these sections in a substantially radial plane.

The assembly of the brush unit 10, indicated in FIGS. 1*a* and 1*b*, includes the step of positioning the arbor 15, stem section 11 first, through the center of the bristle material 12 and into the aperture 18 of the bristle mounting disc 13. The cup holder 14 is seated in a die tool 37 having a cylindrical cavity 38 forming a clearance fit with the exterior of the cup holder. A pilot bushing 39 is pressed into a die cavity counterbore 40 and has an end face 41 slightly below the radial end face 42 of the cavity 38. The bushing insert 39, preferably formed of hardened tool steel, includes a central, cylindrical bore 43 sized to receive the arbor stem section 11 with a sliding fit.

With the cup holder 14 disposed in the die cavity 38, as indicated in FIG. 1*c*, the subassembly of the arbor preform 15, bristle mounting disc 13, and bristles 12 is set into the cup holder 14. A punch tool 44 is suitably guided relative to the die cavity 38, as by a standard die set, for reciprocation centered along the axis of the cavity. The punch 44 is a generally cylindrical body of tool steel with a diameter sufficiently small to fit within an open center of the circular array formed by the bristle bundles. An end face 45 of the punch 44 is generally flat and transverse to the longitudinal axis of the punch.

With the arbor stem section 11 piloted in the bushing bore 43, the intermediate arbor hub section 33 enters the cup holder bore 29 to a point where the arbor shoulder surface 36 engages the bushing end face 41.

A punch 44 is forcibly advanced against the arbor head section 34 to axially compress the hub section 33 against the bushing end face 41, and sufficient force is applied by the punch to permanently radially expand or upset the hub section 33 with plastic flow. As indicated in FIG. 1*b*, the upset is free of radial restriction or confinement by the surfaces of the punch 44 and cavity 38. As a result, the originally cylindrical hub section 33 is significantly altered from its initial configuration while, at the same time, the cup holder bore 29, particularly in the area of the flange 31, is permanently measurably enlarged.

Ideally, both the hub section 33 and bore 29 take the shape of complementary cones. The arbor 15 is locked to the cup holder 14 primarily by radial forces resulting from expansion of the upset hub section 33 into a high degree of radial interference with the cup holder aperture 29. As indicated, the arbor hub section 33 takes the form of a cone which increases in diameter in a rearward direction away from the arbor head 34. By way of example, in one typical brush construction the original hub section has a diameter of 0.375 to 0.380 inch, and is upset to a finished maximum diameter of 0.425 to 0.435 inch. In this process, the arbor stem section 11 is moderately increased in length during the upset of the hub 33, since this hub section is, in effect, extruded into the bore of the pilot bushing 39.

Figure 3:
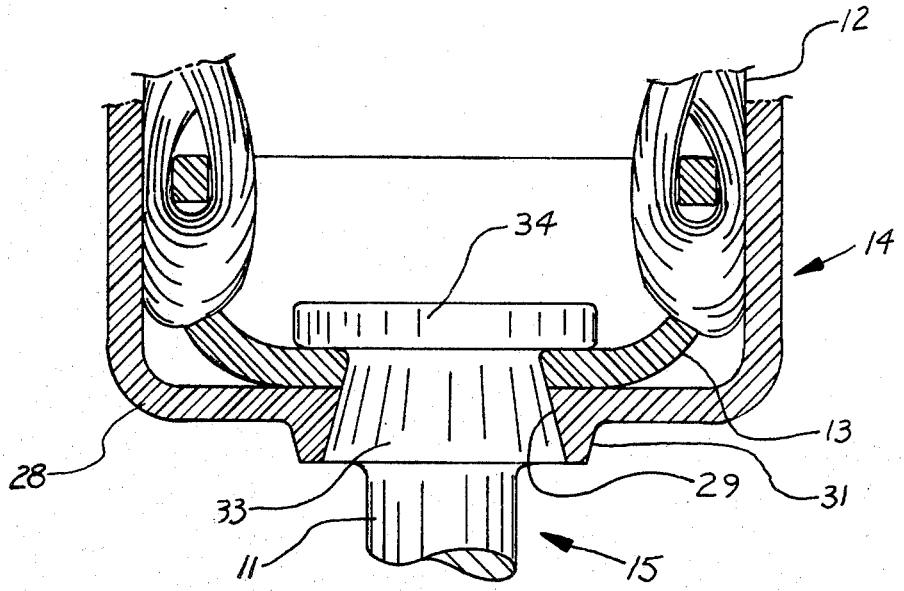
FIG. 3 is an elevational view of the brush assembly, with portions broken away to reveal constructional details thereof.

The final conical configuration of the intermediate hub section of the arbor affords several advantages. From inspection of FIGS. 1*d* and 3, it will be seen that the major diameter of the hub section 33 is significantly larger in diameter than the minor diameter of the cup holder bore 29 adjacent the arbor head 34, so that the cup holder 14 and bristle mounting disc 13 are mechanically interlocked to the arbor 15. The conical shape of the hub section 33 produces a taper lock effect with the complementary final conically shaped bore 29 of the cup holder 14, so as to resist rotational slippage therebetween. The punch 44 is withdrawn from the interior of the brush 10 and the assembly is complete. Any springback of the hub section 33, upon release of the punch 44, is adequately compensated for by a corresponding degree of springback in the cup holder end wall 28 and flange 31. The flange 31 has a springback capacity actually much greater than the hub section 33. The relatively long bore 29 afforded by the flange 31 enhances the stability and rigidity of the joint which it forms with the hub 33.

Figure 4:
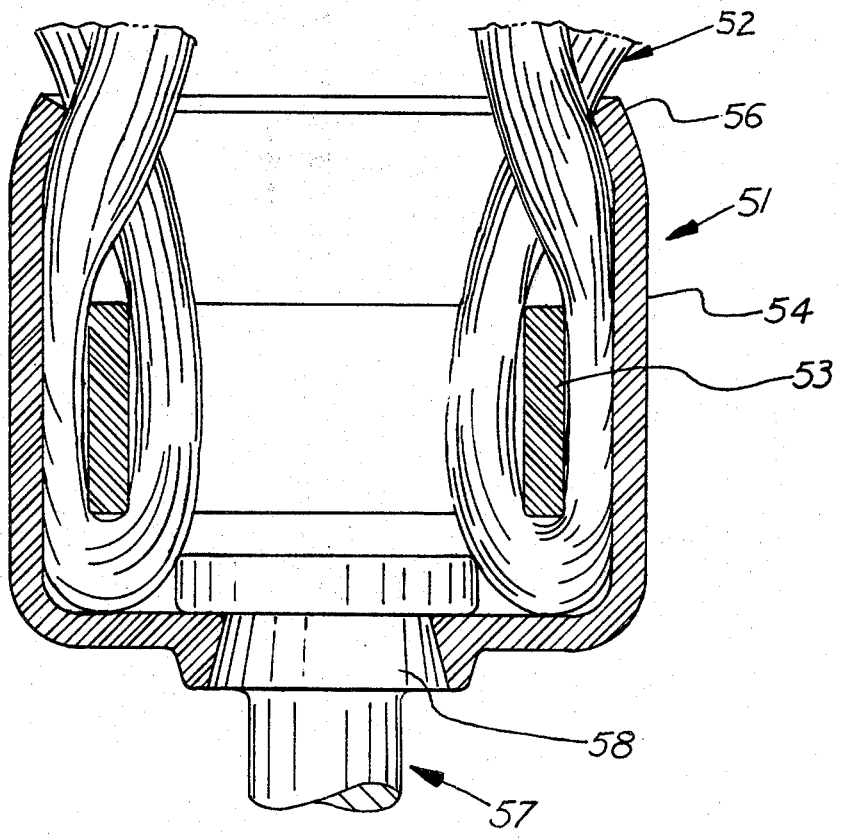
FIG. 4 is an elevational view of a second embodiment of the invention, with portions of a similar brush unit broken away to reveal constructional details thereof.

In FIG. 4 there is illustrated another embodiment of a brush assembly 51 constructed in accordance with the present invention. This type of brush assembly 51 is sometimes referred to as a "crimped wire end brush." In such a construction, wire bristles or filaments 52 are folded over an annular ring 53. After positioning of the bristles 52 on the annular ring 53, these elements are set into a cup holder 54 similar to the holder 14. The bristles 52 are locked in the cup holder by an inturned flange or lip 56 at the outer face of the cup. An arbor 57, similar to the arbor 15 disclosed above, is permanently attached to the cup holder 54 in essentially the same manner as that disclosed in connection with FIGS. 1*b* through 1*d*. In the brush assembly 51, unlike the brush unit 10 illustrated in FIGS. 1–3, the arbor 57 does not lock a bristle mounting disc to the cup holder 54. Accordingly, a hub section 58 of the arbor 57 is foreshortenend from that disclosed in the afore-described brush unit 10. The shorter finished length of the hub section 58 in the brush assembly 51 of FIG. 4 can be accomplished by providing an arbor preform having a hub section somewhat shorter than the hub section 33 of the brush of FIG. 3, or, alternatively, where the arbor preform is of a material with sufficient formability, the same arbor preform configuration can be used in both the brushes of FIG. 3 and FIG. 4, but a greater degree of upsetting and forward extrusion of the hub section is performed in the latter in suitable tooling such as that disclosed in FIGS. 1*b* through 1*d*.

In both embodiments of the brushes 10, 51, the invention affords an improved product. The capacity of the arbor, by selection of high strength material, can readily exceed that of prior brush constructions to permit safe operation at relatively high speeds. The selection of arbor material is not directly limited by materials selected for fabricating the cup holder and, conversely, the cup holder may be selected as a relatively soft material such as brass to avoid scratching a workpiece being brushed without undue regard for the construction of the arbor.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A rotating end brush comprising a cup-shaped holder having an open face at one end and a generally circular, radially extending end wall at the opposite end, a generally cylindrical sidewall integral with and extending axially forwardly from the end wall, the sidewall terminating at an annular edge bounding said open end face, a multitude of bristles anchored in the cup holder and extending forwardly of the cup holder open end face, said cup holder end wall having a central aperture extending axially rearwardly from an area adjacent said sidewall a distance substantially greater than the thickness of said sidewall, a unitary arbor in the form of a generally circular body of stepped diameter, said arbor including successive head, hub, and stem sections, said head section being disposed in the cup holder and being larger in diameter than said aperture, said hub section being disposed in said aperture, and said stem section extending rearwardly away from said hub section and said end wall, said arbor being permanently assembled with said cup holder with an upset formed in said hub section by plastic deformation of the hub section of said arbor formed after positioning of said arbor in said aperture, said upset being limited to said hub section and having a final diametral dimension substantially larger than at least a portion of said aperture forward of said upset whereby said arbor is permanently locked on said cup holder.

2. A rotary end brush assembly as set forth in claim 1, wherein said upset is the result of free radial expansion of the stock of said arbor into said aperture whereby said arbor is locked onto said cup holder primarily by radial interference with said aperture.

3. A rotary end brush assembly as set forth in claim 2, wherein said aperture is formed at least in part by an axially extending flange integral with the remainder of the body of the cup holder.

4. A rotary end brush assembly as set forth in claim 3, wherein said arbor is initially provided as a cold forged part.

5. A rotary end brush assembly as set forth in claim 3, wherein said arbor is formed of a metal having a strength substantially greater than the material forming said cup holder.

6. A rotary end brush assembly comprising a cup-shaped holder having an open face at one end and a generally circular, radially extending end wall at the opposite end, the end wall having a central aperture of an initial diameter, a generally cylindrical sidewall integral with and extending axially forwardly from the end wall, the sidewall terminating at an annular edge bounding said open end face, a multitude of bristles anchored in the cup holder and extending forwardly of the cup holder open end face, said cup holder end wall having a central aperture extending axially rearwardly from an area adjacent said sidewall a distance greater than the thickness of said sidewall, a unitary arbor in the form of a generally circular body of stepped diameter, said arbor including successive head, hub, and stem sections, said head section being disposed in the cup holder and being larger in diameter than said aperture, said hub section being disposed in said aperture, and said stem section extending rearwardly away from said hub section and said end wall, said arbor being permanently assembled with said cup holder with an upset formed in said hub section by plastic deformation of the hub section of said arbor formed after positioning of said arbor in said aperture, said upset being limited to said hub section and having a final diametral dimension substantially larger than at least a portion of said aperture forward of said upset whereby said arbor is permanently locked on said cup holder and said upset being the result of free radial expansion of the stock of said arbor into said aperture whereby said arbor is locked onto said cup holder primarily by radial interference with said aperture, said aperture being formed at least in part by an axially extending flange integral with the remainder of the body of the cup holder, said bristles being carried on a disc-like body, said disc-like body having a central aperture, said arbor including a hub portion passing through said disc-like body aperture, said arbor permanently locking said disc-like body to said holder.

7. A rotary end brush assembly as set forth in claim 3, wherein said bristles are folded over an annulus disposed in said holder, said bristles and annulus being retained in said holder by an inturned flange formed by said annular edge.

8. A rotary end brush assembly comprising a stamped sheet metal cup holder, said cup holder having an open face at one end and a generally radially extending end wall at its opposite end, said cup holder including a cylindrical sidewall integral with said end wall and extending from said end wall axially forwardly to said open end, said end wall having a central aperture formed at least in part by an axially extending flange integrally formed on the end wall, bristle material anchored in said cup holder, a unitary arbor extending through said aperture and being permanently affixed to the cup holder, said arbor being a generally circular body of stepped diameter, a head section of said arbor forming its major diameter and being larger in diameter than said aperture, said head section being disposed in said cup holder adjacent said end wall, a hub section of said arbor seated in said aperture, and a cylindrical stem section of said arbor extending rearwardly of said hub section, said arbor being affixed to said cup holder by a high degree of radial interference between said hub section and said aperture as a result of free radial upsetting of said hub section in said aperture while said head and stem sections are substantially devoid of distortion.

9. A rotary end brush assembly comprising a stamped sheet metal cup holder, said cup holder having an open face at one end and a generally radially extending end wall at its opposite end, said cup holder including a generally cylindrical sidewall integral with said end wall and extending from said end wall axially forwardly to said open end, said end wall having a central aperture extending axially rearwardly from an area adjacent said sidewall a distance substantially greater than the thickness of said sidewall, bristle material anchored in said cup holder, a unitary arbor extending through said aperture and being permanently affixed to the cup holder, said arbor being a generally circular body of stepped diameter, said arbor including a head section, said head section being generally disposed on one side of said end wall and having a diameter greater than that of said aperture, a hub section of said arbor seated in said aperture, and a cylindrical stem section of said arbor extending rearwardly of said end wall, said arbor being affixed to said cup holder by a high degree of radial interference between said hub section and said aperture as a result of free radial upsetting of said hub section in said aperture, said hub section having a conical configuration opposing said head section such that it increases it diameter in a direction away from said head section and is thereby permanently locked to said cup holder as a result of said radial upsetting, said cylindrical stem section having a diameter smaller than the major diameter of said hub section and an axial length greater than the combined length of said head and hub sections.

10. A method of manufacturing an end brush comprising the steps of providing a cup-shaped metal holder having a central aperture in the end wall thereof with the aperture having an axial length substantially greater than the thickness of the sidewall, providing a metal arbor having head, hub, and stem sections, with the head section having a diameter larger than the aperture, inserting the arbor hub section into the cup holder aperture so that the stem section extends rearwardly away from said cup holder, axially compressing the head and hub sections with opposed tool elements in a manner wherein said hub section is caused to upset by plastic deformation into a diameter greater than at least a portion of said aperture to thereby permanently lock said arbor onto said cup holder, and positioning and securing bristle material in said cup holder.

11. A method as set forth in claim 10, wherein said cup holder is provided with an axially extending flange integrally formed therewith and forming at least a part of said aperture, said upsetting of said hub section resulting in a conical configuration of said hub section opposed to and increasing in diameter away from said head section.

12. A method as set forth in claim 11, wherein said arbor is selected from a metal material substantially stronger than the metal material forming said cup holder.

13. A method as set forth in claim 11, wherein said arbor is provided with said hub section intermediate said head section and said stem section, said arbor being assembled to said cup holder by positioning said arbor into said aperture stem first from the open face of said cup holder.

14. A method of manufacturing an end brush comprising the steps of providing a cup-shaped sheet metal holder having a central aperture in the end wall thereof with the aperture having an axial length substantially greater than the thickness of the sidewall, providing a metal arbor having head, hub, and stem sections, with the head section having a diameter larger than the aperture, inserting the arbor hub section into the cup holder aperture so that the stem section extends rearwardly away from said cup holder, axially compressing the head and hub sections with opposed tool elements in a manner wherein said hub section is caused to upset by plastic deformation into a diameter greater than at least a portion of said aperture to thereby permanently lock said arbor onto said cup holder, and positioning and securing bristle material in said cup holder, said cup holder being provided with an axially extending flange integrally formed therewith and forming at least a part of said aperture, said upsetting of said hub section resulting in a conical configuration of said hub section opposed to and increasing in diameter away from said head section, said arbor being provided with said hub section intermediate said head section and said stem section, said arbor being assembled to said cup holder by positioning said arbor into said aperture stem first from the open face of said cup holder, said bristle material being assembled on a carrier disc having a central aperture, said carrier disc being disposed in said cup holder with its aperture aligned with the cup holder aperture, said arbor hub section extending through both of said apertures and being arranged such that said hub section when upset locks said carrier disc in said cup holder.

* * * * *